United States Patent [19]

Braginetz

[11] 4,034,892

[45] July 12, 1977

[54] DISPENSER FOR RAZOR BLADE CARTRIDGES

[75] Inventor: Paul A. Braginetz, Staunton, Va.

[73] Assignee: Philip Morris Incorporated, New York, N.Y.

[21] Appl. No.: 497,453

[22] Filed: Aug. 14, 1974

[51] Int. Cl.[2] ..... B26B 21/24; B65D 83/10

[52] U.S. Cl. ..... 221/64; 30/40.2; 206/356; 221/87

[58] Field of Search ..... 30/40, 40.2; 206/352–360; 221/102, 64, 66, 307–310, 87; 220/20; D9/186, 193

[56] References Cited

U.S. PATENT DOCUMENTS

| | | | |
|---|---|---|---|
| 2,783,875 | 3/1957 | Shabarick | 220/20 X |
| 3,061,136 | 10/1972 | Sterngart | 220/20 |
| 3,771,223 | 11/1973 | Dawidowicz et al. | 221/102 X |
| 3,785,051 | 1/1974 | Dawidowicz et al. | 221/102 X |
| 3,797,657 | 3/1974 | Petrillo | 206/356 |

*Primary Examiner*—Robert B. Reeves
*Assistant Examiner*—Francis J. Bartuska
*Attorney, Agent, or Firm*—Watson, Leavenworth, Kelton & Taggart

[57] ABSTRACT

A dispenser for razor blade cartridges of the character in which one or more blades are permanently secured in a plastic body which has a slidable interlocking connection with a razor head longitudinally of the carriage parallel to the blade cutting edges, the dispenser comprising a cellular arrangement of plastic wall sections forming a plurality of parallel cells connected together as an integral unit each cell having a longitudinal slot at the exterior surface of the unit to receive the razor handle stem, the cells having common walls interiorly of the unit and each cell having interiorly of the cell lug arrangements to prevent accidental escape of the cartridge but cooperative with parts of the razor head and cartridge parts to aid in the insertion and withdrawal of a cartridge.

9 Claims, 15 Drawing Figures

FIG. 1
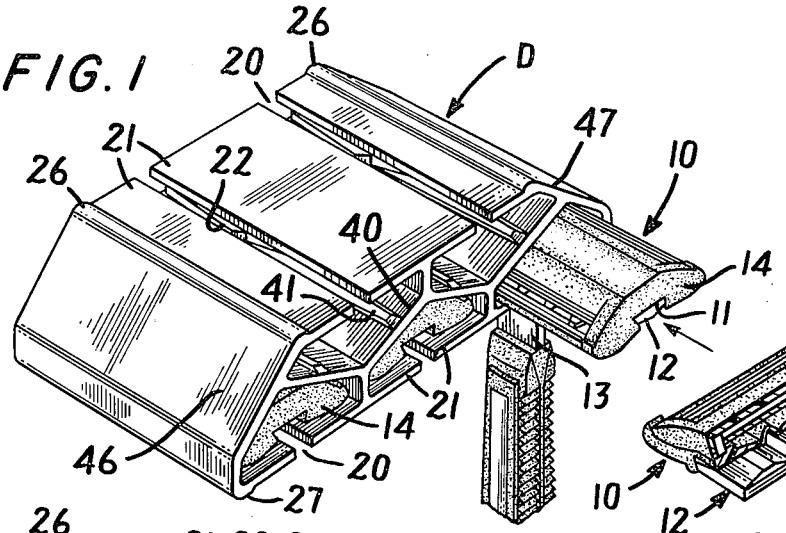
FIG. 1a
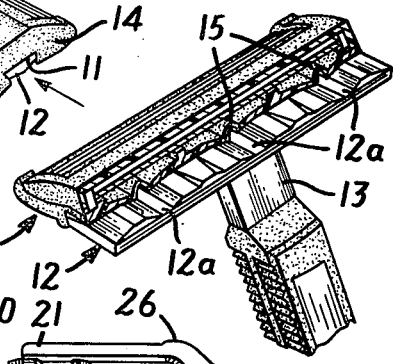
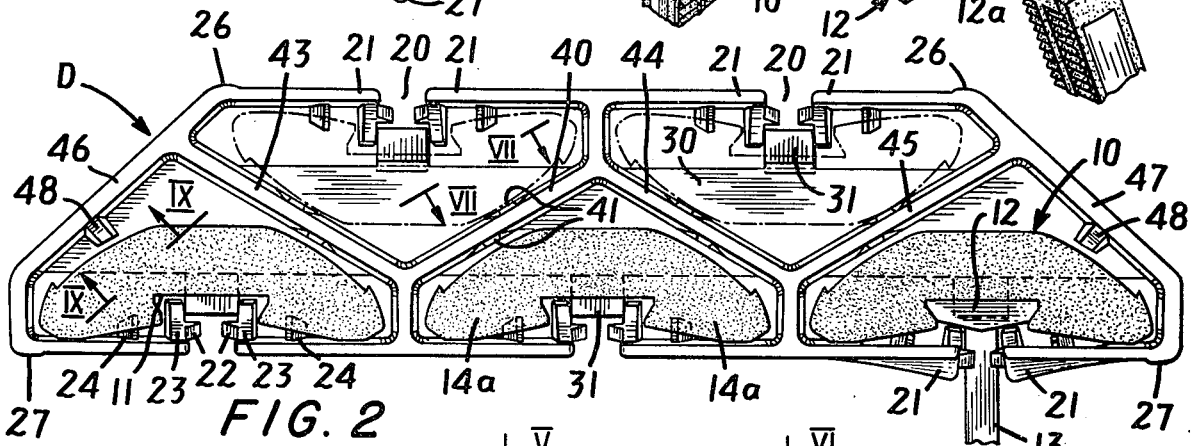
FIG. 2
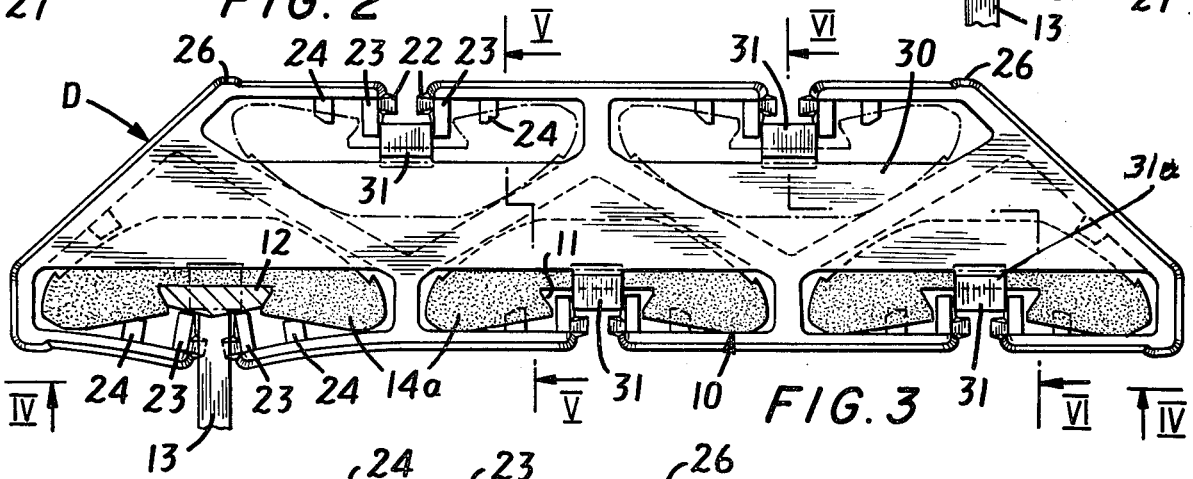
FIG. 3
FIG. 5
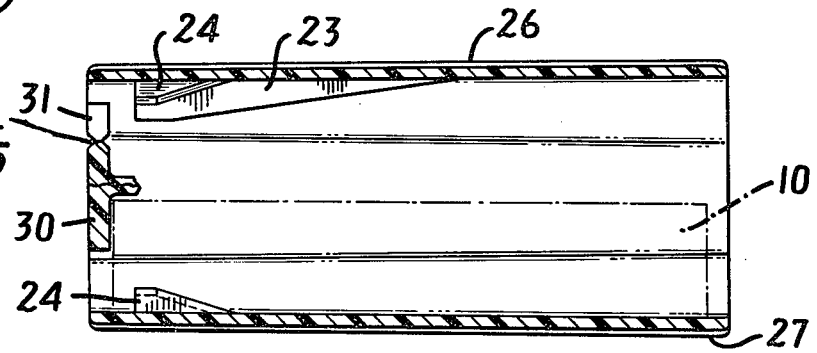

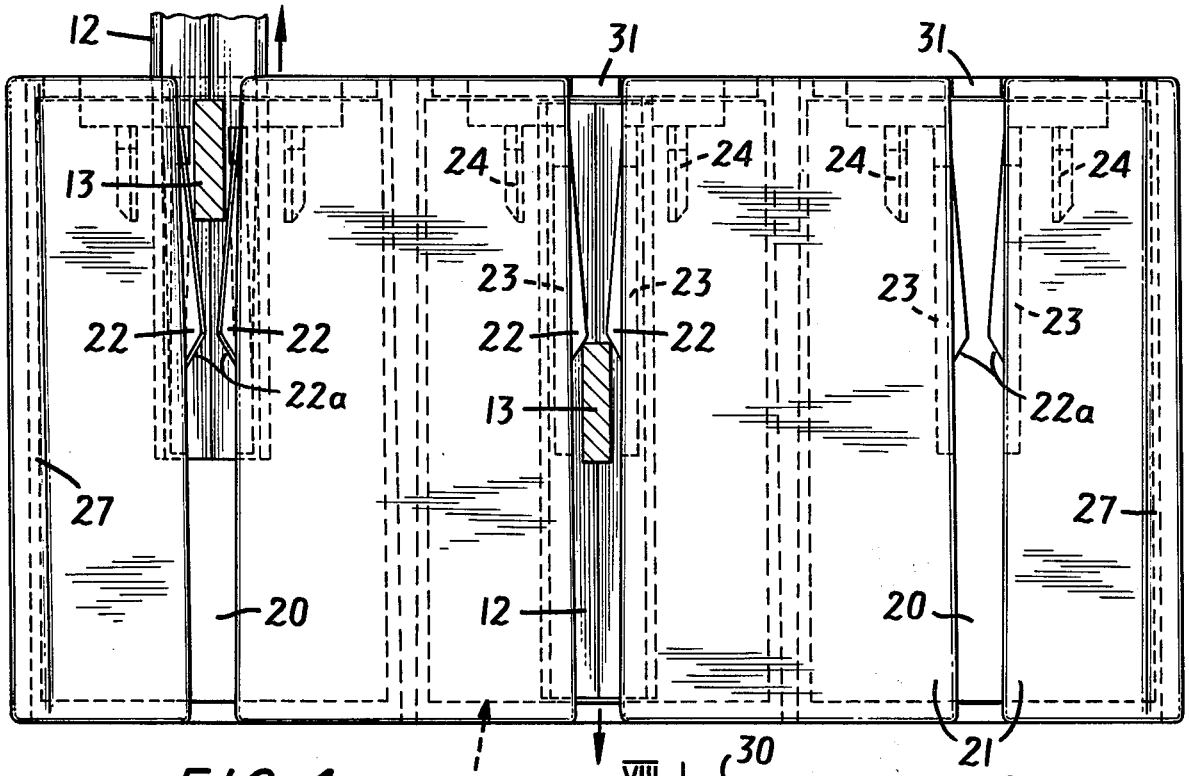
FIG. 4
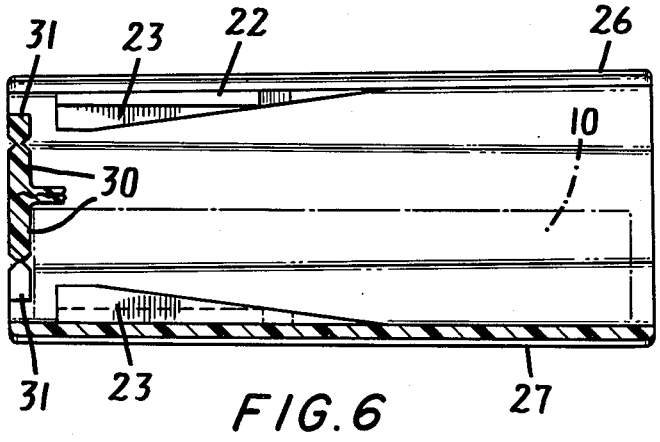
FIG. 6
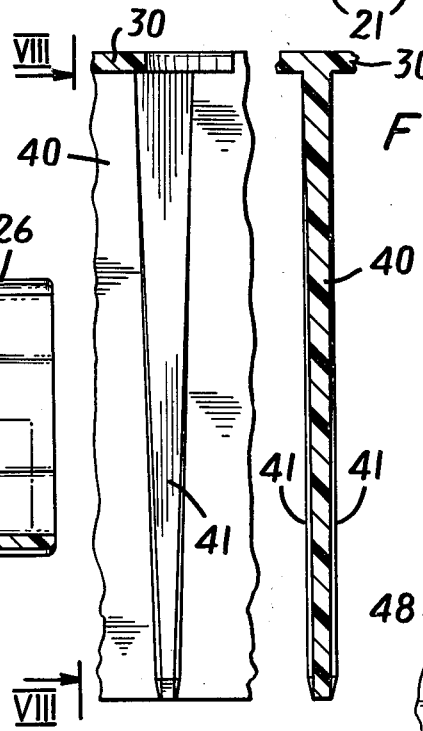
FIG. 8
FIG. 7
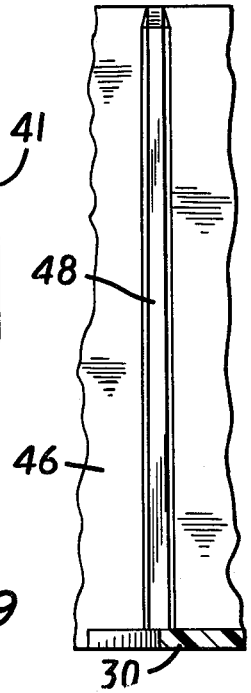
FIG. 9

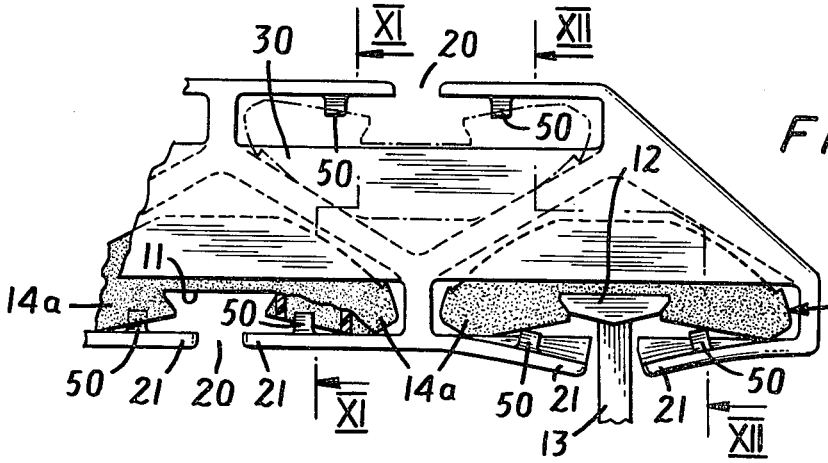
FIG. 10
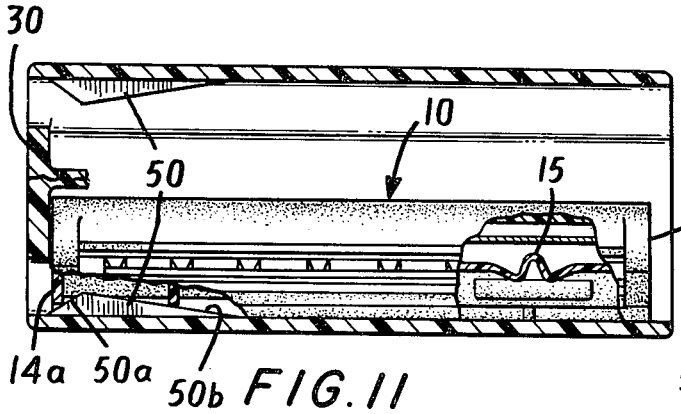
FIG. 11
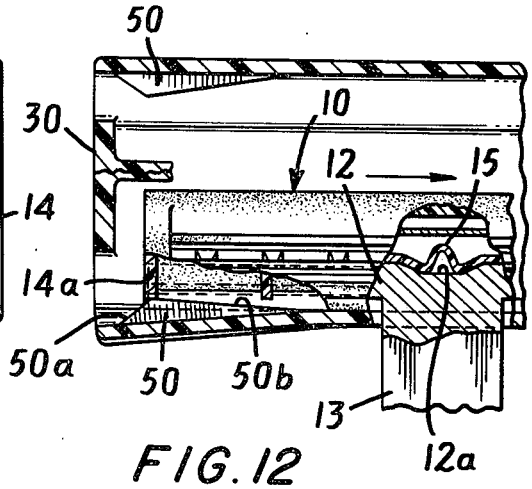
FIG. 12
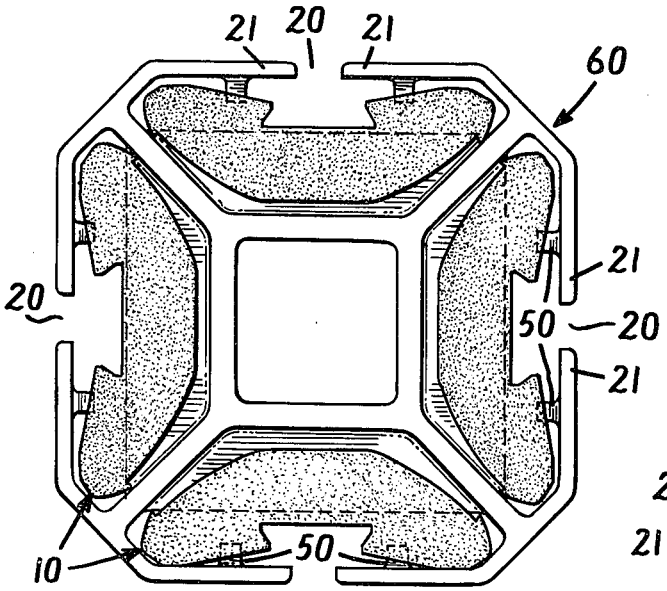
FIG. 13
FIG. 14
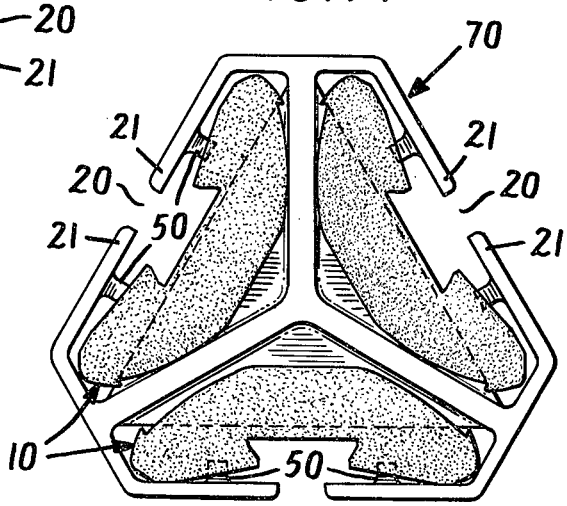

DISPENSER FOR RAZOR BLADE CARTRIDGES

The invention concerns a razor blade cartridge dispenser of the type designed to hold and serve as a dispenser of cartridges adapted to be mounted on a razor handle having a key slidably engageable in a longitudinal slot in the bottom of the cartridge parallel to the blade cutting edge.

Various specific forms of a handle and cartridge combination of such general character are known in the art, examples thereof being the subject of U.S. Pat. Nos. 3,771,223; 3,785,051 and 3,797,657. The present dispenser is particularly adapted for dispensing cartridges of a character employed in the razor combination of applicant's prior patent application Ser. No. 313,742 filed Dec. 11, 1972. Blade cartridges of the general type referred to above are characterized by a plastic body in which one or more blades are permanently secured. In many cases the dispenser comprises a tray with top cells in which the cartridges are mounted and guide means are provided to direct a key on the razor into slidable interlocking engagement with the cartridge. The individual cartridges in such cases are bodily inserted or removable by a rocking action. In other cases the cartridges are arranged in a stack in a rectangular casing and are removable or insertable in an endwise direction relative to the container. The applicant's above noted application discloses this latter type of cartridge and dispenser. The U.S. Pat. Nos. 3,771,223 and 3,785,051 cited above disclose both types of dispensers described above.

The dispenser of the present invention comprises a compact cellular arrangement of wall sections forming a plurality of cells connected together as an integral unit each cell providing an elongated chamber extending axially of the unit for reception of the cartridge and each cell having a longitudinally extending slot arranged in the exterior surface of the unit to receive the stem of a razor blade. The individual cells embody an arrangement of elements including lugs positioned on the inner surface of the cells on flanges defining the longitudinal slot for the razor stem, the lugs serving to releasably lock the cartridge in the cell and being displaceable by action of the razor head or handle stem to permit endwise removal of the cartridge and likewise displaceable to permit the insertion of a cartridge into a normal locked position therein. The dispenser is composed of relatively thin plastic material and deflection of the flange parts defining the slot or other wall section is readily effected for the functioning of the lugs in locking or releasing the cartridges.

Other features and functional advantages of the dispenser will be made apparent by consideration of representative embodiments of the invention as described hereinafter and as depicted in the drawings in which:

FIG. 1 is a perspective view of the presently preferred form of the invention, the figure including a showing of the razor handle and a cartridge being inserted into the dispenser.

FIG. 1*a* is a perspective view of a razor handle head adapted to engage in a slot in the cartridge.

FIG. 2 is a vertical front end view of the dispenser.

FIG. 3 is a vertical rear end view of the dispenser.

FIG. 4 is a bottom plan view taken in the direction of the arrows IV—IV of FIG. 3.

FIG. 5 is a vertical cross sectional view taken on the broken line V—V of FIG. 3.

FIG. 6 is a vertical cross sectional view taken on the broken line VI—VI of FIG. 3.

FIG. 7 is a fragmentary view taken on the line VII--VII of FIG. 2.

FIG. 8 is a fragmentary cross sectional view on the line VIII—VIII of FIG. 7.

FIG. 9 is a fragmentary view taken on the line IX—IX of FIG. 2.

FIG. 10 is a vertical front end view of another embodiment of the invention.

FIG. 11 is a vertical cross sectional view taken on the broken line XI—XI of FIG. 10.

FIG. 12 is a vertical cross sectional view taken on the broken line XII—XII of FIG. 10.

FIG. 13 is an end view of another form of the invention with a different arrangement of the cells.

FIG. 14 is a view similar to FIG. 13 but showing a still different arrangement of cells.

the dispenser D of FIG. 1 to 9 comprises a honeycomb cellular unit of molded plastic material having in this example five cells or vaults interfitting and compactly arranged with common walls to form a generally flat oblong unit. Other honeycomb arrangements may be employed as indicated in FIGS. 13 and 14 which will be referred to again hereinafter. As previously stated the dispenser unit is particularly designed for use with a razor cartridge arrangement like that of the previously mentioned application of the present inventor Ser. No. 313,742. The dispenser cells each comprise a generally hollow chamber conforming in cross section to the shape of the cartridge and having therefore a generally triangular shape. The details of the cartridge may be varied but as shown in the above noted previous application the razor and cartridge is of a double edge type, the cartridge being symmetrical in cross section with double cutting edges at each side. The cartridge 10 has in the bottom face of dovetail longitudingal slot 11 in which is engageable a razor head in a form of a key 12 mounted on a razor stem 13. The cartridge had end walls 14 (FIGS. 1 and 11) and extending downwardly in the slot 11 are flexible detents, one such being shown at 15 in FIGS. 11 and 12. The upper surface of the razor head key 12 has depressions 12*a* adapted to receive the detents for releasably positioning the cartridge on the handle. In the bottom face of the cartridge at each side of the slot 11 are longitudinal channels closed at the ends by wall portions 14*a* as indicated for example in FIG. 2.

Each cell has a longitudinal slot 20 positioned between opposed flange portions 21. The individual cells have a generally triangular shape in cross section with a base of the triangle comprising the side with the slot 20 arranged at the outside and at least one of the other sides having a common wall with an adjacent cell resulting in the compact arrangement with all of the active slots 20 located at the exterior surface. Mounted on the flanges in association with the slots 20 are a group of pairs of lugs 22, 23 and 24, the character and functions of which will be more fully described hereinafter. Preferably the dispenser is provided with protruding rounded corners extending longitudinally of the body as indicated at the top at 26 and at the bottom at 27 which serve as skids or runners to protect the top and bottom surfaces respectively. The rear end has a barrier strip 30 which prevents cartridges from escaping at the rear but permits the razor head 12 to pass through for depositing a used cartridge in the cell as will be described more in detail. The exit at the rear for the razor head at each cell may be initially covered by a tab 31 (FIGS. 4, 5 and 6) which is displaceable or rupturable by the razor head as it passes out the rear end in the deposit of a used cartridge. The tab may be provided in any convenient manner which the present example comprises a small section cast integral with the dispenser and connected to the strip 30 by a reduced area 31*a*. The plastic material is preferably a styrene which is readily ruptured by engagement of the razor head.

Compatible with the compact arrangement with common walls between certain pairs of the cells and in the interest of conserving plastic material and convenience of molding operations special cartridge guiding and supporting surfaces are provided. In general the wall sections and various elements taper from the back end to a corresponding reduced dimension at the front end to render the unit more readily removable from the casting mold in the direction of the rear wall. However, to accommodate the same geometry of the cartridge at the front and back of the chamber certain variations or features are embodied. FIGS. 7 and 8 depict the wall common 40 common to two of the cells. A rib 41 is provided at each surface of the wall which tapers down laterally parallel to the wall surface but maintains a uniform height or thickness in a direction perpendicular to the wall. By reference to FIG. 8 it may be noted that the thickness of the main wall tapers down from the rear end to the front end but the thickness at the rib 41 remains constant. This is possible because of the reduced surface area of the ribs 41 exposed for contact by the cartridge. The same conditions exist at the wall 43, 44 and 45. The end outer walls 46 and 47 provide another form of rib 48 which tapers down laterally as indicated in FIG. 9 but maintains a constant height.

The structure and functioning of the dispenser will be made more readily apparent from a description of representative operations. Initially the cells will each contain a cartridge, or one may be empty to receive a used cartridge. As positioned in a cell the rear end wall 14 on the cartridge will be positioned beyond cartridge locking lugs 24 as indicated for example in the cells shown in FIG. 3 except the one at the extreme left. The cartridge therefore is restrained from accidentally sliding out in the reverse direction. To pick up a cartrdige the razor head key is slid into the slot from the open end until the detents 15 fall into the notches 12*a* in the top surface of the key as previously described. This correct positioning of the razor key will be indicated to the user by the razor stem 13 coming into engagement with lugs 22 which project laterally into the slot as shown particularly in FIG. 4. The lugs function therefore as what may be termed "soft stops". By a little extra effort the razor stem may be moved against the relatively steep ramps 22*a* and carried on through as will be described later herein. In advancing to the mid-position just described the flanks of the key 12 ride up on the ramps of the lugs 23 causing the flanges 21 to be flexed downwardly as shown in the cell at the extreme right in FIG. 2 and at the extreme left in FIG. 3. In this position the locking lugs 24 are moved down free of the end wall 14 of the cartridge and reverse movement of the razor handle carried with it the cartridge. To deposit a used cartridge in an empty cell the cartridge mounted on the handle is inserted at the front end and advanced to the position where the stem occupies the position shown at the middle cell in FIG. 4 and then continued on past the soft stops 22, the progress being shown in the cell at the left in FIG. 4. In such advance the tab 31 is ruptured or pushed free. The locking lugs 24 are shorter and of less height than the camming lugs 23 to provide clearance with respect to the cartridge other than acting as a restraint when the cartridge is free of the razor key 12. In the advance of the razor stem past the soft stop lugs 22 the walls of the dispenser to which the flanges 21 are fixed will flex to permit the stem to advance past the high points of the lugs 22. If desired a used cartridge may be retrieved from the dispenser by an operation similar to that described in picking up a new cartridge. If the dispenser is initially provided with the tabs 31 the absence or ruptured condition of the tab will indicate that the cartridge in that cell is a used one.

Another form of dispenser embodying the major principles of the invention having a simplified lug arrangement is shown in FIGS. 10 to 12. In this case a single pair of lugs 50 is provided which serve the functions of the pairs of lugs 23 and 24 of the form of FIGS. 1 to 9. The lugs 50 have ramps in both directions the ramp 50*a* facing the rear preferably being steeper than the ramp 50*b* facing the front. Normally the cartridge is positioned as shown in FIG. 11 and at the left in FIG. 10 with the end wall portions 14*a* located beyond the steeper ramp 50*a* effective to restrain the cartridge against accidental or unintentional escape. To remove the cartridge from a cell the razor key is slid into the slot from the front end of the dispenser to the full extent where the cartridge detents engage in the depressions in the top surface of the razor key 12. Then upon reverse movement of the razor key the end wall portions 14*a* ride up the respective ramps 50*a* of the lugs 50 camming the flanges 21 and the lugs to the positions shown in FIG. 12 and at the right in FIG. 10 releasing the cartridge from the restraint of the lugs 50. The conditions including the flexibility of the flanges 21 and the locking force of the detents in the top surface of the key 12 are chosen such that the forces of the detents together with the frictional engagement of the key 12 in the cartridge slot are sufficient to overpower the restraining forces effected by the lugs 50.

The deposit of used cartridges, and the retrieval of used cartridges are accomplished similarly to the operations with the dispenser first form of FIGS. 1 to 9. Also various structural features may correspond thereto such as incorporating soft stop lugs like lugs 22 and rupturable tabs 31.

The compact arrangement of the dispenser may have other geometric forms in which however the slots 20 are exposed at the outer surface areas and each cell has one or more inner wall sections on the interior of the unit in common with one or more other cells. Variations of that character are indicated by the dispenser 60 of FIG. 13 and the dispenser 70 of FIG. 14. The generally triangular shape in cross section of the cells lends itself to such compact designs and permits the access slots 20 to be positioned at the outer surface. These forms indicate a lug 50 arrangement similar to the form of FIGS. 10 to 12 but of course the lug arrangement of the form of FIGS. 1 to 9 may be employed.

Since various further changes may be made in the structural details and relations of the parts shown in the dispenser forms described herein and accordingly different embodiments of the invention be made within the principles thereof, it is intended that all matter contained herein shall be interpreted as illustrative and not in a limiting sense.

What is claimed is:

1. A dispenser unit for elongated cutting blade cartridges said unit comprising a cellular arrangement of wall sections forming a plurality of cells connected together as an integral unit each cell having a longitudinal opening extending axially of the unit constructed and arranged to receive a cartridge longitudinally slidable in and out thereof, and each cell having a side with a longitudinally extending slot to receive the stem of a cartridge holder movable along the slot, and a common inner wall section with an immediately adjacent cell which has the said slot, the said side with the slot being arranged in each case at the exterior surface of the unit, the individual cells each having a generally triangular shape in cross section with the base of the triangle comprising the side with the slot arranged at the exterior surface of the unit, and at least one of the other sides being the wall section common with an adjacent cell interiorly of the unit.

2. A dispenser for elongated cutting blade cartridges which cartridges have at the bottom face downwardly projecting end walls defining a recess inside each end wall, the dispenser having wall portions defining a longitudinally extending chamber adapted to receive endwise therein a cartridge, said wall portions including an outer wall with a slot extending longitudinally thereof defined by opposed flanges, said slot permitting the passage therealong of the stem of the cartridge holder, the inner surface of one of said flanges having a lug extending into a bottom recess of a cartridge when positioned in said chamber to releasably restrain said cartridge from escape, said flange with the lug being flexible whereby the flange may be flexed outwardly to release the lug from the cartridge permitting it to be manually withdrawn.

3. A dispenser in accordance with claim 2 in which each of the flanges is flexible and has a lug.

4. A dispenser in accordance with claim 2 in which said chamber has one open end permitting the free entrance of a cartridge mounted on a holder and an opposite end with a restricted opening shaped to permit the holder to pass entirely through the chamber but barring the exit of the cartridge therethrough whereby to deposit the cartridge in the chamber free of the holder.

5. A dispenser in accordance with claim 4 in which said restricted opening has thereover a member rupturable by the passage therethrough of the holder.

6. A dispenser unit for elongated cutting blade cartridges said unit comprising a cellular arrangement of wall sections forming a plurality of cells connected together as an integral unit each cell having a longitudinal opening forming a chamber extending axially of the unit to receive therein a cartridge and an outer side wall with a longitudinally extending slot therein exposed at the outer surface of the unit to receive the stem of a cartridge holder movable along the slot, said outer side wall being thin walled and adapted to flex outwardly at the slot under pressure from a cartridge engaged in the chamber, the inner surface of each of said flanges having a lug arranged to extend into a bottom recess of the cartridge when positioned in the chamber to releasably restrain the cartridge from escaping endwise.

7. A dispenser in accordance with claim 6 in which the chamber has an open end permitting free entrance of a cartridge on a holder into engagement with said lugs, and an opposite end with a restricted opening shaped to permit the holder to pass entirely through the chamber but barring the exit of the cartridge.

8. A dispenser for elongated cutting blade cartridges which cartridges have at the bottom face downwardly projecting end walls defining a recess inside each end wall, the dispenser having wall portions defining a longitudinally extending chamber adapted to receive endwise therein a cartridge, said wall portions including an outer wall with a slot extending longitudinally thereof defined by opposed flanges, said slot permitting the passage therealong of the stem of the cartridge holder, the inner surface of one of said flanges having a first lug extending into a bottom recess of a cartridge when positioned in said chamber to releasably restrain said cartridge from escape, said flange with the lug being flexible whereby the flange may be flexed outwardly, said flange having a second camming lug engageable by the holder when positioned in the chamber to cam outwardly the said flange to release said first lug from the cartridge permitting it to be manually withdrawn.

9. A dispenser for elongated cutting blade cartridges which cartridges have at the bottom face downwardly projecting end walls defining a recess inside each end wall, the dispenser having wall portions defining a longitudinally extending chamber adapted to receive endwise therein a cartridge, said wall portions including an outer wall with a slot extending longitudinally thereof defined by opposed flanges, said slot permitting the passage therealong of the stem of the cartridge holder, the inner surface of one of said flanges having a first lug extending into a bottom recess of a cartridge when positioned in said chamber to releasably restrain said cartridge from escape, said flange with the lug being flexible whereby the flange may be flexed outwardly, said lug having inclined edges facing inwardly and outwardly of the chamber respectively with an intermediate peak portion engageable by a cartridge end wall to cam the corresponding flange and its lug outwardly permitting endwise movement of the cartridge in either direction.

* * * * *